US006406264B1

(12) United States Patent
Paulus

(10) Patent No.: US 6,406,264 B1
(45) Date of Patent: Jun. 18, 2002

(54) PROPELLER

(76) Inventor: Robert D. Paulus, 23820 Sunny Glen Dr., Eagle River, AK (US) 99577

( * ) Notice: Subject to any disclaimer, the term of this patent is extended or adjusted under 35 U.S.C. 154(b) by 0 days.

(21) Appl. No.: 09/630,325

(22) Filed: Jul. 26, 2000

(51) Int. Cl.[7] ..... F01D 5/14
(52) U.S. Cl. ..... 416/236 R
(58) Field of Search ..... 416/175, 189, 416/193 R, 203, 93 R, 93 A, 236 R, 236 A

(56) References Cited

U.S. PATENT DOCUMENTS 2,265,788 A * 12/1941 Wolf, Sr. et al. ..... 416/236 A
2,327,453 A * 8/1943 Presser ..... 416/236 A
D142,260 S * 8/1945 Lee ..... 416/193
2,426,742 A * 12/1947 Pawlowski ..... 416/189 R
4,047,835 A * 9/1977 Hornung ..... 416/236 A
4,128,363 A * 12/1978 Fujikake et al. ..... 416/175 R
4,130,378 A * 12/1978 Eichler ..... 416/236 A
4,362,469 A * 12/1982 van Holten ..... 416/191
6,102,661 A * 8/2000 Robson et al. ..... 416/189

* cited by examiner

*Primary Examiner*—Edward K. Look
*Assistant Examiner*—James M McAleenan
(74) *Attorney, Agent, or Firm*—Michael J. Tavella

(57) ABSTRACT

A propeller that has curved vanes attached to the blade tips and to the blade body. The curved vanes at the blade tips act as a nozzle. However, because the "nozzle" is attached to the propeller blades, there is no need to modify the boat motor to accommodate it. In this design, the nozzle turns with the propeller. A full blade ring or guard can be formed and attached to the blades, if desired. This ring not only enhances the nozzle effect, it also protect people and items from getting drawn up into the blades of the propeller. This improves propeller safety as well. The propeller blades can have a number of different vane configurations. Moreover, there is a design that allows for variable pitch of the blades.

8 Claims, 5 Drawing Sheets

PROPELLER

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to propellers and particularly boat propellers having auxiliary vanes for improved performance.

2. Description of Related Art

The screw propeller has been in use for well over a century. It enabled steam-powered ships to sail efficiently as compared to the paddle wheel. Despite this improvement, the propeller itself has some problems in producing the best efficiency. A propeller is essentially a set of fan blades that turn in the water. These blades direct water away from the blades in a flame shaped plume, which elongates and increases in efficiency as the speed of the vessel increases. Despite this action, which does propel a ship forward, the propeller blades also throw water from the blades in a tangential pattern extending from the blade edge. Thus, water is thrown outward from the propeller at angles ranging from 0 degrees to 90 degrees. Moreover, the blades even let water fall over the face of the blades, which creates an inefficient back eddy. All water that is not propelled directly perpendicular to the blades reduces the efficiency of the propeller.

One method of improving the efficiency of propellers uses a pipe shroud to encase the propeller. This shroud or nozzle forces more of the water directly out from the propeller. An example of such a system is the Kort nozzle used on large ships. Small boats can also use nozzles, but these often require modification of the motor or boat to accommodate them.

BRIEF SUMMARY OF THE INVENTION

The present invention solves the efficiency problem by producing a propeller that has curved vanes that attach to the blade tips and to the blade body. The use of the curved vanes produces a nozzle effect without the nozzle. The vanes attached to the body of the blade further improve water flow by reducing the tangential flow. Thus, more water is forced directly back from the propeller in the desired direction, which makes the propeller more efficient. Moreover, as noted above, the curved vanes at the blade tips act as a nozzle. However, because the "nozzle" is attached to the propeller blades, there is no need to modify the boat motor to accommodate it. In this design, the nozzle turns with the propeller.

A full blade ring or guard can be formed and attached to the blades, if desired. This ring not only enhances to the nozzle effect, it also protect people and items from getting drawn up into the blades of the propeller. This improves propeller safety as well. The propeller blades can have a number of different vane configurations. Moreover, there is a design that allows for variable pitch of the blades.

It is an object of the invention to produce a propeller having curved vanes at the tips of the propeller blades to generate more efficient water flow.

It is another object of the invention to produce a propeller having curved vanes on the body of each propeller blade to generate more efficient water flow.

It is yet another object of the invention to produce a propeller having a combination of curved vanes at the tips of the propeller blades and curved vanes on the body of each propeller blade to generate more efficient water flow.

It is yet another object of the invention to produce a propeller having a combination of curved vanes at the tips of the propeller blades and curved vanes on the body of each propeller blade to generate more efficient water flow and also having a variable pitch element.

DETAILED DESCRIPTION OF THE INVENTION

Figure 1:
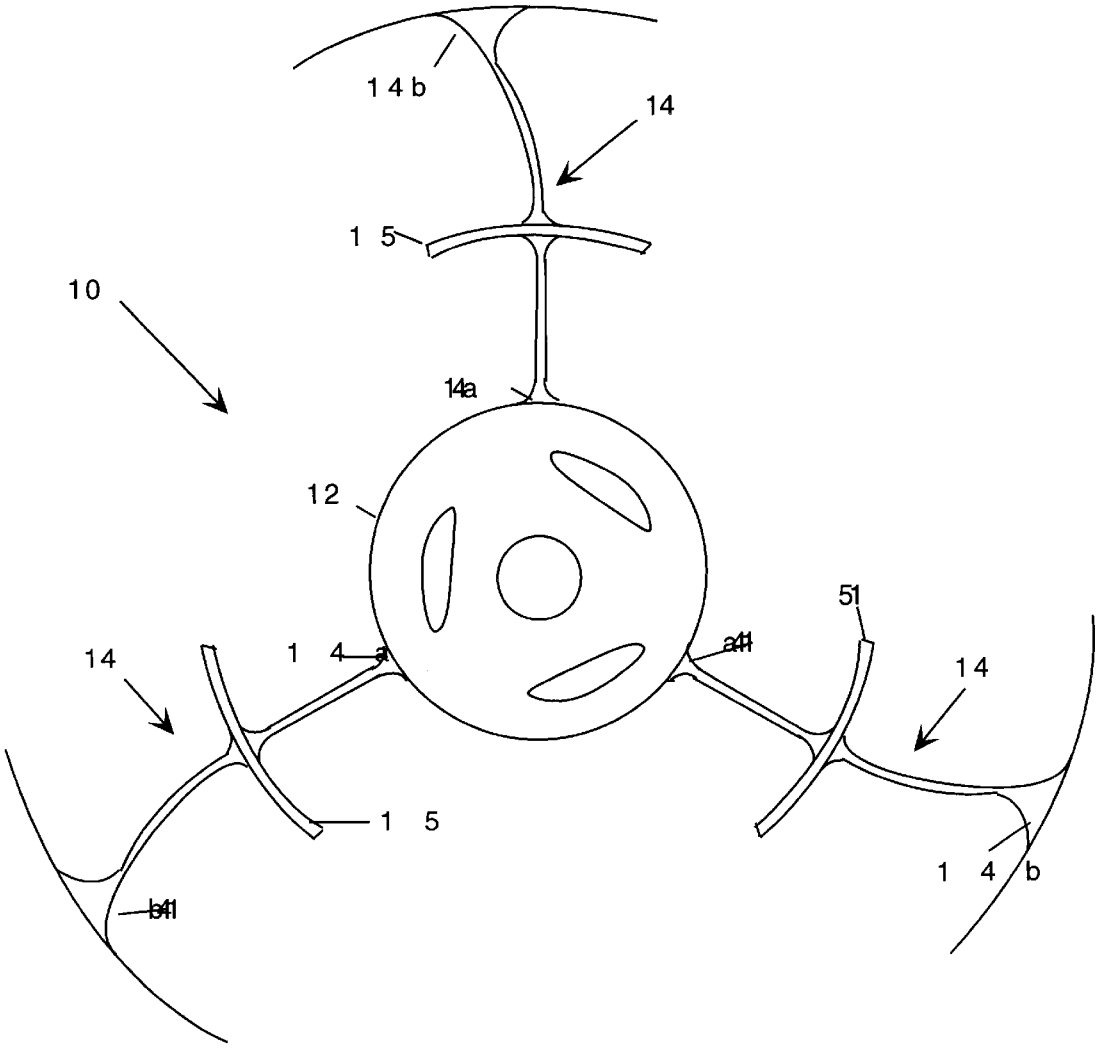
FIG. 1 is a cross-sectional view of one embodiment of the invention.
Figure 4:
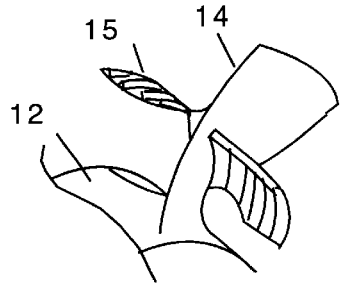
FIG. 4 is a perspective detail view of one of the blades of the invention.

Referring now to FIGS. 1 and 4, my new propeller 10 is shown. The propeller 10 has a central hub 12. The central hub is formed of common design and has a central hole for accepting the shaft and a cylindrical body that holds the blades. In the preferred embodiment, the propeller 10 has three blades 14 as shown. The blades 14 are placed symmetrically around the hub 12. Each blade has a proximate end 14*a*, terminating on the hub 12 and a distal end 14*b* that forms the outer edge of the blade. In the embodiment of FIG. 1, the distal end 14*b* of the blades has a curved vane attached to it or formed on it, that creates a partial shroud as shown.

Figure 3:
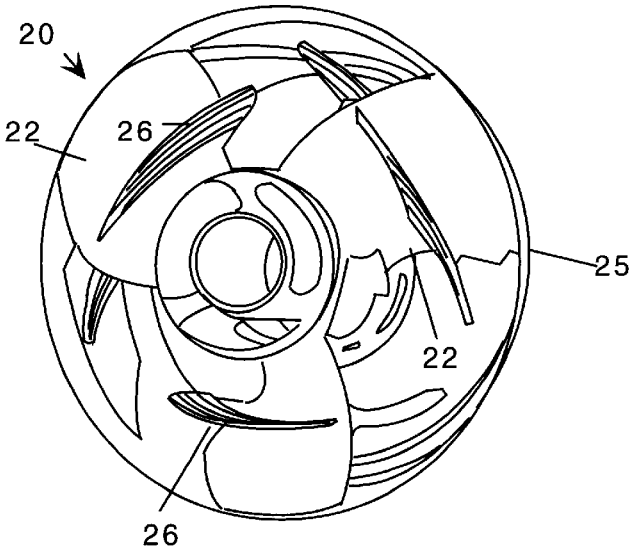
FIG. 3 is a perspective view of the second embodiment of the invention.
Figure 5:
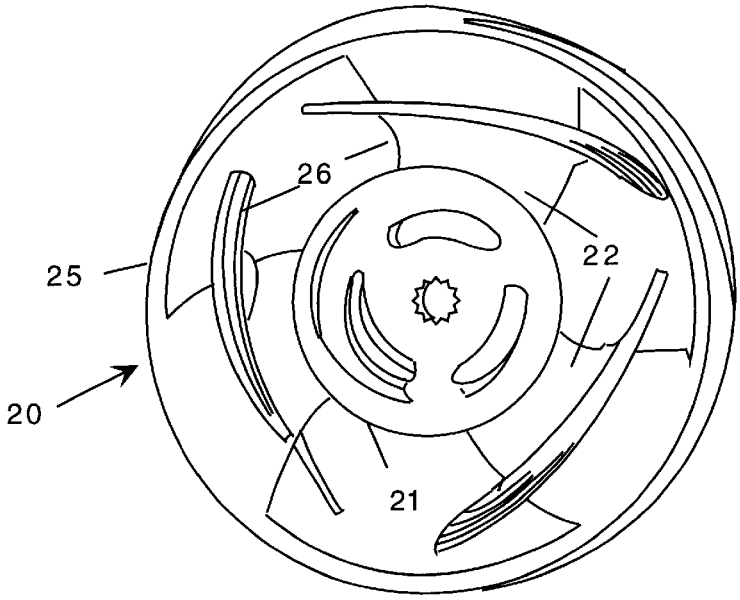
FIG. 5 is a rear view of the second embodiment.

Spaced intermediate between the proximate and distal ends of each blade is a vane 15 see also FIG. 4. The vane 15 is attached to the blade 14 by welding or casting or by similar means known in the art. The vane is curved as shown. In the preferred embodiment, the vanes are smooth. However, they may also be ribbed as shown in FIGS. 3, 4 and 5. As discussed above, the vanes improve water flow by reducing the tangential flow. Thus, more water is forced directly back from the propeller in the desired direction, which makes the propeller more efficient.

Figure 2:
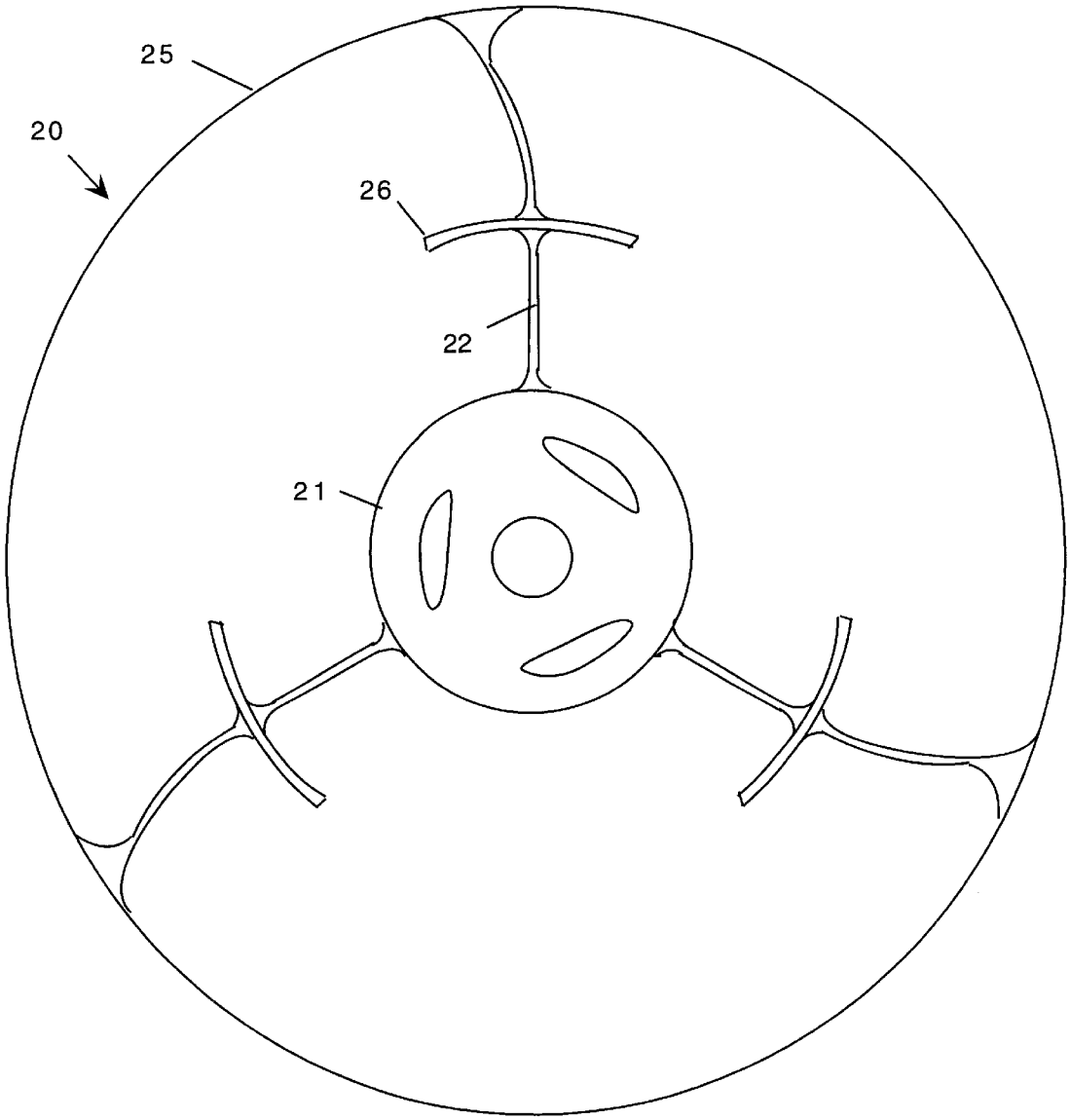
FIG. 2 is a cross-sectional view of a second embodiment of the invention.

Referring now to FIGS. 2, 3 and 5, a second embodiment 20 of the invention is shown. This embodiment has a central hub 21 and, in the preferred embodiment, three blades 22 as before. Here, however, the curved vanes at the distal ends of the blades are replaced with a full shroud 25. The shroud acts to help direct the water flow as discussed above. Note however, unlike traditional shrouds, both the curved blades and the full shroud are fixed to the blades and are designed to rotate with the blades.

As before, this embodiment has intermediate vanes 26. That work to improve efficiency. Note that these blades are curved as shown. Note also that the vanes may be smooth or ribbed, as discussed above.

Figure 6A:
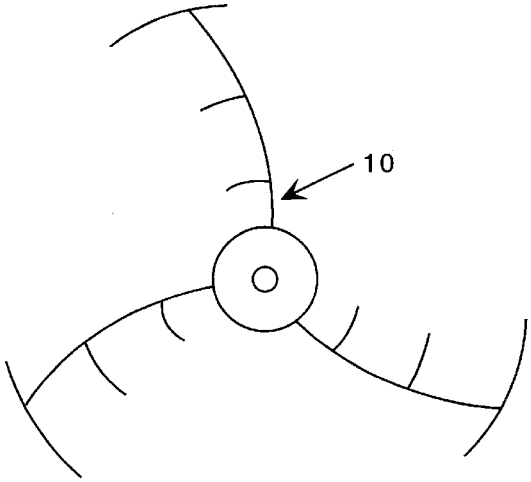
FIG. 6*a* is a detail view of an alternate blade and vane configuration.
Figure 6B:
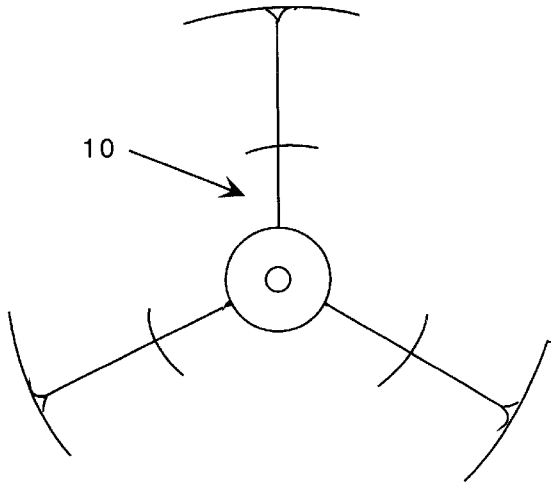
FIG. 6*b* is a detail view of a second alternate blade and vane configuration.
Figure 6C:
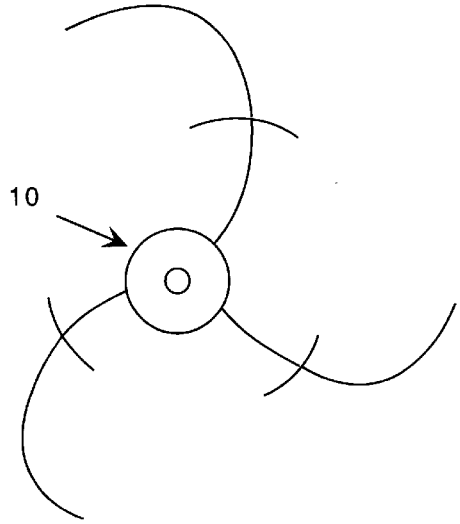
FIG. 6*c* is a detail view of a third alternate blade and vane configuration.

FIGS. 1 and 2 show a single intermediate vane for each blade. However, the propeller is not limited to only one vane per blade or one simple blade configuration. FIGS. 6*a*, 6*b* and 6*c* show variations in vane design including double vanes on one side of the blade (FIG. 6*a*), blades that are widened at the distal and proximate ends (FIG. 6*b*) and blades that have a distinct curve (FIG. 6*c*).

Figure 7:
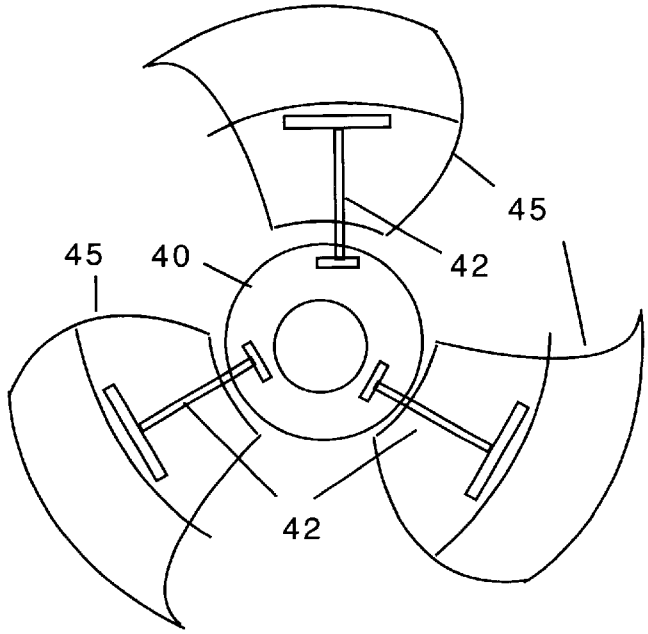
FIG. 7 is a cross-sectional view of a third embodiment of the invention.
Figure 8:
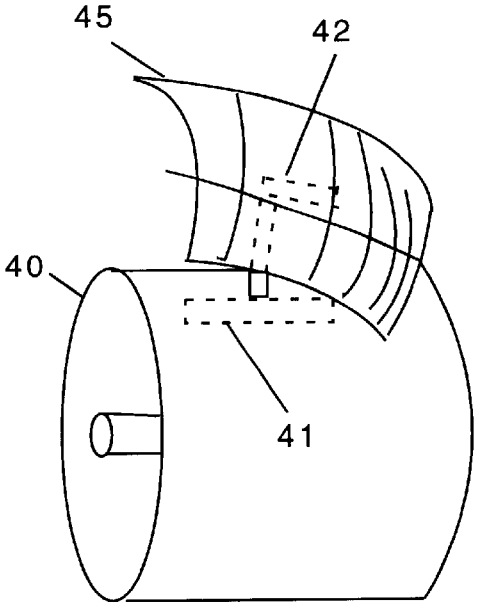
FIG. 8 is partial perspective detail view of the third embodiment of the invention.

FIGS. 7 and 8 show a third embodiment. In this embodiment, the blades are designed for a variable pitch. This design is used on boats with variable loads or for general boat applications where blades flex at acceleration. The system automatically increases the pitch of the propeller using torsion bars, as the load on the propeller decreases. This then allows the operator to maintain uniform operating engine speed over a range of operating loads and conditions.

FIG. 8 shows details of the hub 40. The hub has a slot or hole 41 that allows a torsion bar 42 to pass through the outer wall of the hub. In this embodiment, the blades 45 are not fixed to the hub 40. Instead, The torsion bar 42 enters the blade 45 forward of center. In this way, the load on the blade surface is disproportionate on the backside of the blade 45. This causes the torsion bar to flex and relieve the load as needed to maintain the engine at normal operating speeds.

As before, the blades 45 are fitted with vanes 46 to further improve efficiency. Any combination of vanes may be used with this embodiment, with the blades being made up as before. The only difference is that these blades are secured to the torsion bars instead of the hub.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A propeller comprising:

a) a central hub;

b) at least two blades, attached to said central hub, each blade having a distal end, a proximate end, an outer surface and an inner surface; and c) a first vane, having a plurality of ribs formed thereon, attached to the inner surface of each of said blades; and d) a second vane having a plurality of ribs formed thereon, attached to the outer surface of each of said blades.

2. The propeller of claim 1 further comprising: a curved shroud vane, attached to the distal end of each of said blades.

3. The propeller of claim 1 further comprising a cylindrical shroud, whereby each distal end of each of said blades is attached to said cylindrical shroud.

4. The propeller of claim 1 wherein each vane is curved.

5. A propeller comprising:

a) a central hub;

b) three blades, each blade being attached to said central hub, each blade having a distal end, a proximate end, an outer surface and an inner surface;

c) a first ribbed vane, attached to the inner surface of each of said blades; and d) a second ribbed vane, attached to the outer surface of each of said blades.

6. The propeller of claim 5 further comprising: a curved shroud vane, attached to the distal end of each of said blades.

7. The propeller of claim 5 further comprising a cylindrical shroud, whereby each distal end of each of said blades is attached to said cylindrical shroud.

8. The propeller of claim 7 wherein each vane is curved.

* * * * *